US009620000B2

(12) United States Patent
Wang et al.

(10) Patent No.: US 9,620,000 B2
(45) Date of Patent: Apr. 11, 2017

(54) WEARABLE SYSTEM AND METHOD FOR BALANCING RECOGNITION ACCURACY AND POWER CONSUMPTION

(71) Applicant: TCL RESEARCH AMERICA INC., San Jose, CA (US)

(72) Inventors: Haohong Wang, San Jose, CA (US); Nathaniel Rossol, San Jose, CA (US)

(73) Assignee: TCL RESEARCH AMERICA INC., San Jose, CA (US)

( * ) Notice: Subject to any disclaimer, the term of this patent is extended or adjusted under 35 U.S.C. 154(b) by 128 days.

(21) Appl. No.: 14/585,221

(22) Filed: Dec. 30, 2014

(65) Prior Publication Data

US 2016/0189534 A1 Jun. 30, 2016

(51) Int. Cl.
*G08B 21/00* (2006.01)
*G08C 17/00* (2006.01)

(52) U.S. Cl.
CPC ..... *G08C 17/00* (2013.01)

(58) Field of Classification Search
CPC ..... G08C 17/00; H04Q 9/00; H04Q 2209/40
USPC ..... 340/870.16
See application file for complete search history.

(56) References Cited

U.S. PATENT DOCUMENTS

2013/0107905 A1* 5/2013 Campbell ..... G01F 25/0007 374/1
2015/0361960 A1* 12/2015 Agarwal ..... F03D 7/0224 416/1

FOREIGN PATENT DOCUMENTS

CN 102918356 A 2/2013

* cited by examiner

*Primary Examiner* — Tanmay Shah
(74) *Attorney, Agent, or Firm* — Anova Law Group, PLLC

(57) ABSTRACT

A method for balancing recognition accuracy and power consumption is provided. The method includes activating a plurality of sensors onboard a device for a first time period and calculating sensor readings by using a calculation function. The method also includes determining a plurality of sensor subsets of the plurality of sensors and calculating corresponding errors for the plurality of sensor subsets for the first time period. Further, the method includes calculating respective power consumption of running the sensor subsets of the plurality of sensors from the plurality of sensor subsets that produce the error below the user-defined error threshold and selecting a sensor subset with minimum power consumption from the sensor subsets as an optimal sensor subset. In addition, the method includes deactivating the plurality of sensors not in the optimal sensor subset and calculating and displaying sensor readings with the optimal sensor subset for a second time period.

16 Claims, 6 Drawing Sheets

WEARABLE SYSTEM AND METHOD FOR BALANCING RECOGNITION ACCURACY AND POWER CONSUMPTION

FIELD OF THE INVENTION

The present invention generally relates to the field of computer technologies and, more particularly, to a wearable system and method for balancing recognition accuracy and power consumption.

BACKGROUND

As technology penetrates further into all aspects of people's daily lives, wearable sensor devices (e.g., pedometers, smart watches, sport watches, fitness trackers) have recently become more personalized, becoming tailored to fit unique lifestyles and scheduled for each user. For example, a fitness tracker becomes quite popular in tracking daily fitness results and setting goals. The wearable sensor devices are also useful for medical geriatric or ambulatory monitoring of individuals in order to assess levels of independence.

Although a high level of physical activity recognition accuracy has been achieved in the past using sensors (or sensor arrays), these approaches are not very effective when sensor placement is less optimal. To address this problem, additional onboard sensors (such as gyroscopes and magnetic compasses) can help disambiguate human motion data and greatly improve recognition accuracy.

However, these additional sensors consume significantly more electrical power, and drastically reduce the battery life of the wearable system. In general, as indicated in this disclosure, the power consumption rate of these additional sensors is too large to leave active over the course of a day while tracking a user's activities. To save the power, it is important to know when to activate and deactivate the additional sensors. The additional sensors are activated only as needed in order to attempt to maintain pre-set recognition accuracy while keeping the power consumption of the wearable system minimized as much as possible. A desired goal for the wearable sensor devices is not only to maximize the physical activity recognition accuracy, but also to simultaneously minimize the electrical power consumption onboard the wearable sensor devices.

The disclosed wearable systems and methods are directed to solve one or more problems set forth above and other problems.

BRIEF SUMMARY OF THE DISCLOSURE

One aspect of the present disclosure includes a method for balancing recognition accuracy and power consumption. The method includes activating a plurality of sensors onboard a device for a first time period and calculating sensor readings by using a calculation function. The method also includes determining a plurality of sensor subsets of the plurality of sensors and calculating corresponding errors for the plurality of sensor subsets for the first time period. Further, the method includes calculating respective power consumption of running the sensor subsets of the plurality of sensors from the plurality of sensor subsets that produce the error below the user-defined error threshold and selecting a sensor subset with minimum power consumption from the sensor subsets as an optimal sensor subset. In addition, the method includes deactivating the plurality of sensors not in the optimal sensor subset and calculating and displaying sensor readings with the optimal sensor subset for a second time period substantially longer than the first time period.

Another aspect of the present disclosure includes a wearable system for balancing recognition accuracy and power consumption. The system includes a sensor data calculation module configured to calculate sensor readings of a plurality of sensors by using a calculation function when the plurality of sensors onboard a device are activated for a first time period and a determination module configured to determine a plurality of sensor subsets of the plurality of sensors. The system also includes an error calculation module configured to calculate corresponding errors for the plurality of sensor subsets for the first time period and compare the obtained errors to a certain user-defined error threshold. Further, the system includes a power consumption calculation module configured to calculate power consumption of running the sensor subsets of the plurality of sensors using a power consumption function for the plurality of sensor subsets that produce the error below the certain user-defined error threshold and a selection module configured to select a sensor subset with minimum power consumption as an optimal sensor subset and deactivate a plurality of sensors not in the optimal sensor subset.

Other aspects of the present disclosure can be understood by those skilled in the art in light of the description, the claims, and the drawings of the present disclosure.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

Reference will now be made in detail to exemplary embodiments of the invention, which are illustrated in the accompanying drawings. Wherever possible, the same reference numbers will be used throughout the drawings to refer to the same or like parts.

Figure 1:
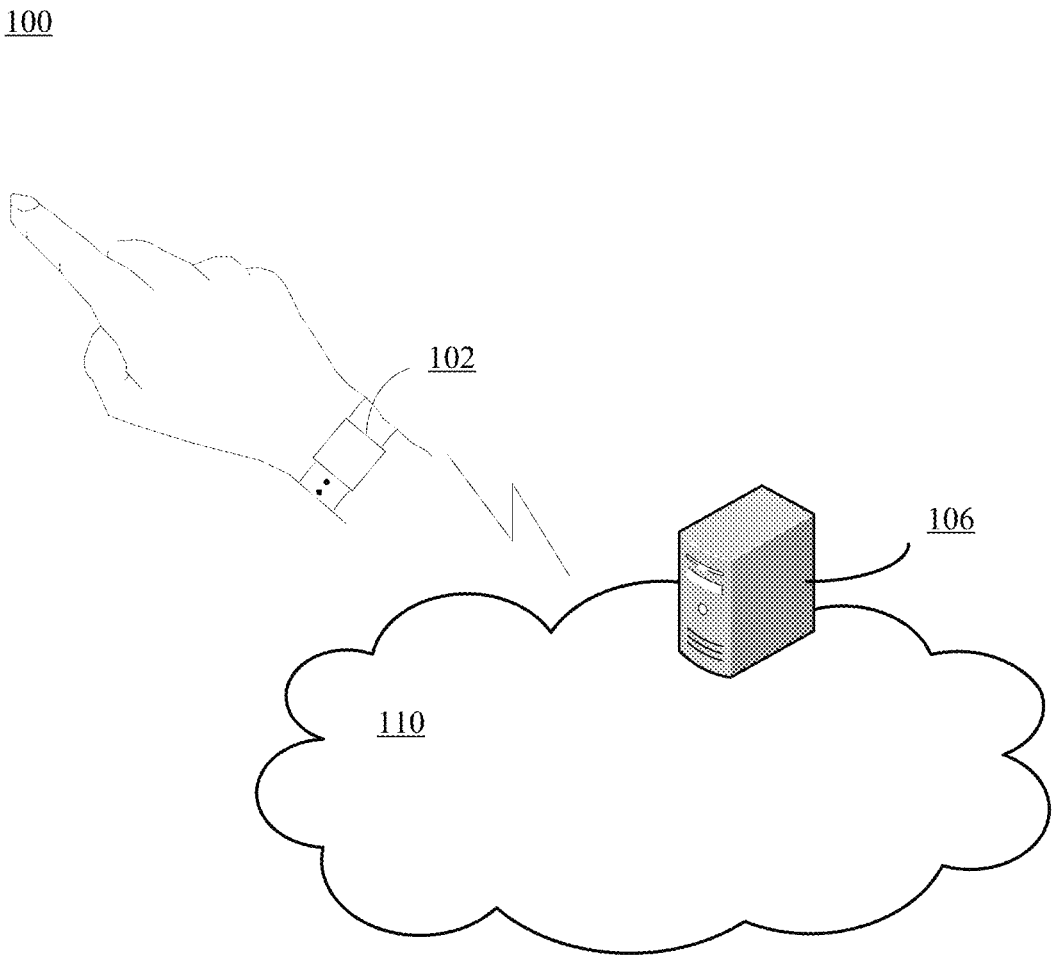
FIG. 1 illustrates an exemplary environment incorporating certain embodiments of the present invention.

FIG. 1 illustrates an exemplary environment 100 incorporating certain embodiments of the present invention. As shown in FIG. 1, environment 100 may include a wearable system 102, a server 106, and a network 110. Other devices may also be included.

Wearable system 102 may include any appropriate type of smart wearable system, such as a smartwatch, or a pair of smartglasses.

Further, the server 106 may include any appropriate type of server computer or a plurality of server computers for providing contents to wearable system 102. The server 106 may also facilitate communication, data storage, and data processing for wearable system 102. Wearable system 102 and server 106 may communicate with each other through one or more communication networks 110, such as a cable network, a phone network, and/or a satellite network, etc. In certain embodiments, server 106 may also include any type of personal computing platform, such as an iPhone or other smartphone, a notebook computer, a tablet computer, or a personal computer, etc. The communication network 110 may include any near-field communication network or wireless network.

A user may interact with wearable system 102 using gestures to browse information and perform other activities of interest, or the user may simply use hand or gestures to control wearable system 102 by motion sensors. Wearable system 102, and/or server 106 may be implemented on any appropriate computing circuitry platform.

Figure 2:
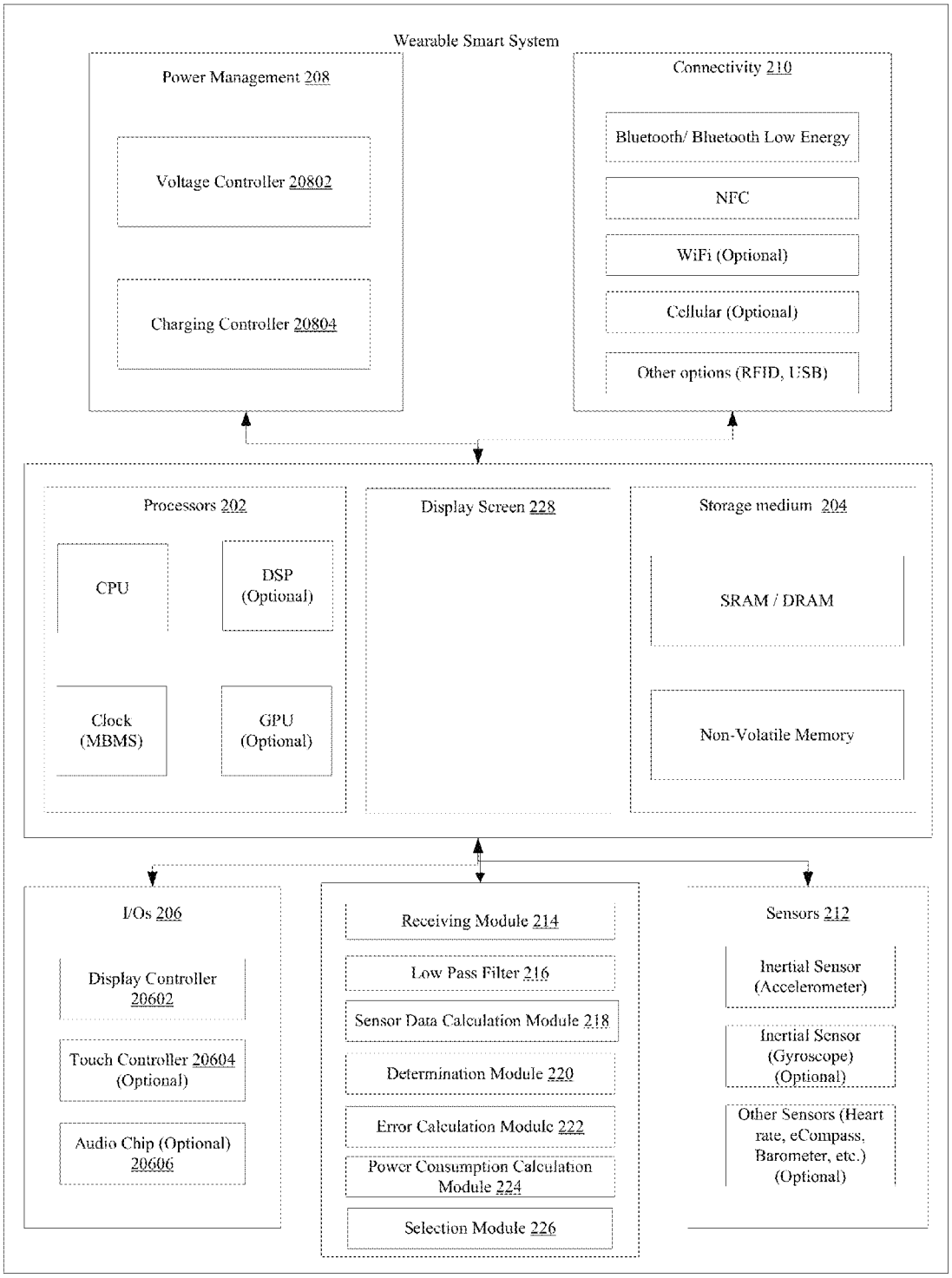
FIG. 2 illustrates a block diagram of an exemplary wearable system consistent with the disclosed embodiments.

FIG. 2 illustrates a block diagram of an exemplary wearable system consistent with the disclosed embodiments. A wearable system may include a processor 202, a storage medium 204, input/output (I/O) devices 206, a power management module 208, connectivity modules 210, sensors 212, a receiving module 214, a low pass filter 216, a sensor data calculation module 218, a determination module 220, an error calculation module 222, a power consumption calculation module 224, a selection module 226, and a display screen 228. Certain devices may be omitted and other devices may be included.

Processor 202 may include any appropriate processor or processors. Further, processor 202 can include multiple cores for multi-thread or parallel processing. The processor 202 may include at least one Central Processing Unit (CPU) and a clock module. More than one CPU may also be included in the wearable system. The number of CPUs is not limited herein. Some optional components may be included, such as a Digital Signal Processor (DSP) and a Graphics Processing Unit (GPU). The DSP may also be a part of sensor module to process a sensor input signal.

In one embodiment, the CPU may be an ARM processor. The clock component may be used as an internal timing device for the wearable system. A microcontroller may also include a clock interface, which is connected to the power management module 208 to control a CPU speed according to a power state of the system.

Storage medium 204 may include memory modules, such as a random access memory (RAM) and a non-volatile memory, etc. Storage medium 204 may store computer programs for implementing various processes when the computer programs are executed by processor 202. For example, a system may include a Static Random Access Memory (SRAM) inside the microcontroller for a small embedded system, and an external Dynamic Random Access Memory (DRAM) interface. The RAM may be used as a main memory for the processors for supporting execution of software routines and other selective storage functions. The non-volatile memory is capable of holding instructions and data without power and may store the software routines for controlling modules. The non-volatile memory may be a flash memory or a read only memory (ROM).

I/O devices 206 may include a display controller 20602, a touch controller 20604, and an optional audio chip 20606. The display controller 20602 may access RAM and transfer processed data, such as time and data and/or a user interface, to display screen 228 (e.g. a touch screen) for display. Touch controller 20604 may interface with the display screen 228 (e.g. a touch screen) to detect touches and touch locations and pass the information on to processor 202 for determination of user interactions. The audio chip 20606 can be used to generate a simple tone for indicating some events, or may support full audio processing according to system requirement. An optional component may include a microphone interface to interface an optional microphone in the device to get the command by voice.

In one embodiment, the device can be implemented without sound capability. That is, no audio chip speaker or microphone is included. A touch screen controller may interface with the touch screen to detect touch locations and pass the information on to the processor 202. The display screen 228 can also be implemented without a touch interface. Display screen 228 may include any appropriate display screen. For example, display screen 228 may be an Organic Light Emitting Diode (OLED) touch screen display or a Liquid Crystal Display (LCD) touch screen display.

Power management module 208 communicates with the processor 202 and coordinates power management for the device while the device draws power from a battery (e.g. a rechargeable lithium ion battery) during normal operations. The power management module 208 may include a voltage controller and a charging controller for recharging the battery. The voltage controller 20802 may regulate a battery voltage to the rest of the device. The charging controller 20804 may manage appropriate voltage levels to properly charge the battery. Power management module 208 may be a part of microcontroller with the processor or a separate microcontroller. The voltage controller 20802 can have more than a voltage level to support a sleep or suspended mode of the device.

Connectivity modules 210 may include components for supporting one-way or two-way wireless and/or wire communications. The wearable system may use Bluetooth low energy as a main communication mean to outside world. However, other communication modes (e.g., Near Field Communication (NFC), wireless fidelity (Wi-Fi), and Cellular) may be used. The communication modes are not limited herein.

A plurality of sensors 212 are representative of devices that can take information of outside world and supply the obtained information to the devices. The sensors 212 can also function with other components to provide environmental input and feedback to the user. The sensors 212 may include at least one inertial sensor and any number of optional sensors. The inertial sensor can include a Micro-Electro-Mechanical System (MEMS) accelerometer that is used to measure information, such as position, motion, tilt, etc. The inertial sensor may also include a gyroscope to provide information about movement of the wearable system. The inertial sensor can track motions in three axes. Other sensors (e.g., a magnetic compass, a heart rate sensor, an eCompass sensor, a barometer sensor, a blood pressure sensor, etc.) may also be included in the system.

The sensors 212 may be configured to establish a three-dimensional (3D) coordinate system, including an X axis direction being from left to right horizontally, a Y axis direction being from bottom to top vertically, and a Z axis direction being from back to front and perpendicular to a display screen of a wearable system.

Further, the receiving module 214 may be configured to receive motion information from the plurality of sensors 212. For example, receiving module 214 may receive acceleration information in the 3-axis directions from the plurality of sensors.

The low pass filter 216 may be configured to filter the received acceleration information to remove noises. The received acceleration information is filtered using Low Pass Filtering (LPF) to remove noises.

The sensor data calculation module 218 is configured to calculate sensor readings by using a calculation function when a plurality of sensors onboard the device are activated for a first time period $T_e$. The first time period $T_e$ is a fixed time period (e.g., 15 seconds) that may be set up by a user or by the system. The determination module 220 is configured to determine a plurality of sensor subsets of the plurality of sensors.

The error calculation module 222 is configured to calculate corresponding errors for the plurality of sensor subsets for the first time period and compare the obtained errors to a certain user-defined error threshold. The power consumption calculation module 224 is configured to, from the plurality of sensor subsets that produce the error below the user-defined error threshold, calculate respective power consumption of running the sensor subsets of the plurality of sensors.

The selection module 226 is configured to select a sensor subset with minimum power consumption from the sensor subsets as an optimal sensor subset and deactivate a plurality of sensors not in the optimal sensor subset.

The sensor data calculation module 218 is also configured to calculate sensor readings with the optimal sensor subset for a second time period $T_b$. The second time period $T_b$ is substantially longer than the first time period $T_e$. That is, $T_b \gg T_e$.

Figure 3:
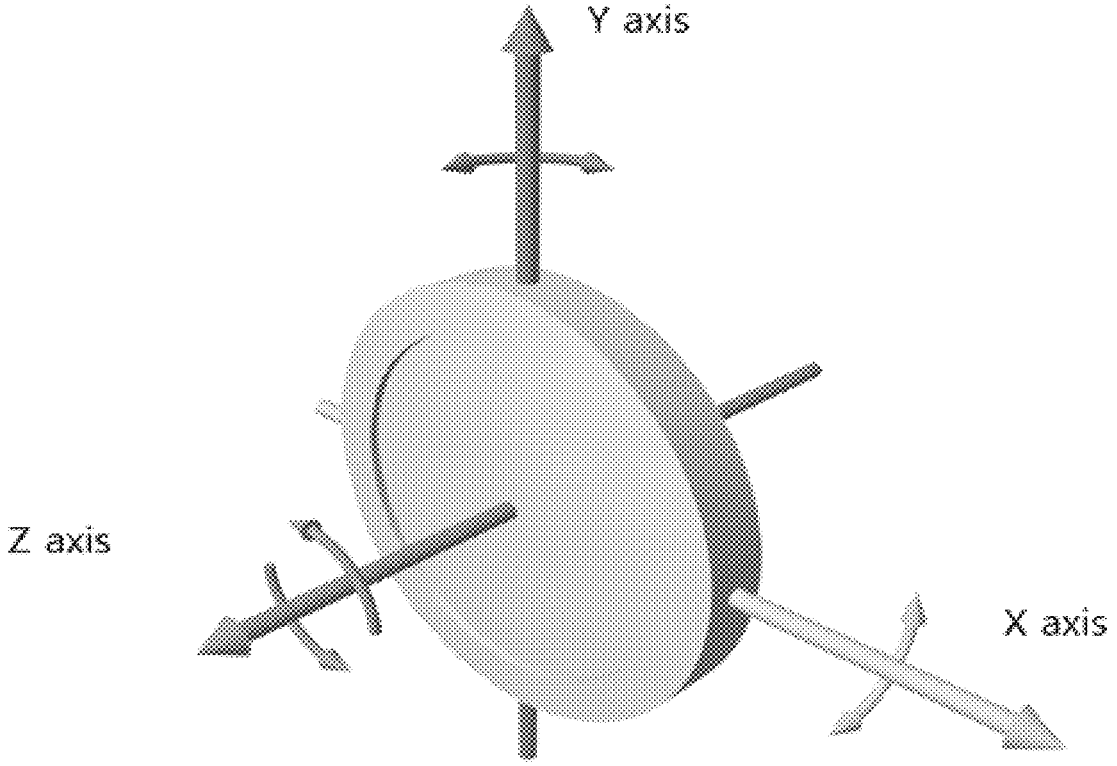
FIG. 3 shows three axes of a wearable system consistent with the disclosed embodiments.

FIG. 3 shows three axes of a wearable system consistent with the disclosed embodiments. As shown in FIG. 3, a three-dimensional (3D) coordinate system on a wearable system is established, where an X axis (i.e., horizontal axis) direction is from left to right horizontally; a Y axis (i.e., vertical axis) direction is from bottom to top vertically; and a Z axis direction is from back to front and perpendicular to a display screen of the wearable system.

Figure 4:
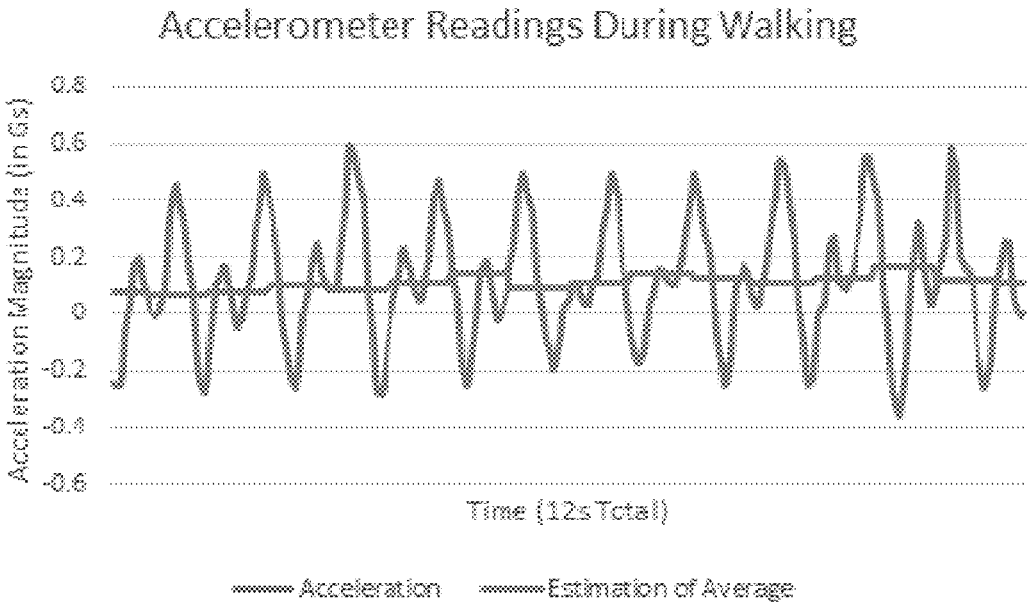
FIG. 4 shows magnitude of acceleration experienced by a tri-axial accelerometer worn on a user's wrist during walking.

FIG. 4 shows magnitude of acceleration experienced by a tri-axial accelerometer worn on a user's wrist during walking. As shown in FIG. 4, acceleration magnitude is calculated in a normal fashion by taking the square root of the sum of squares of each accelerometer axis. The acceleration is the rate of change in velocity and is measured in Gs. The acceleration magnitude is between −0.4 Gs and 0.6 Gs in 12 seconds. This signal is also low-pass filtered for smoothness by removing noises. The rate of change of acceleration (also known as jolt) is expressed in Gs per second. By computing a running average of the signal values which is updated intermittently (e.g., every second), the number of steps taken can be determined in close to real-time by counting each instance where the signal crosses below a threshold.

The signal in FIG. 4 represents a relatively ideal case where the signal result is quite clear to read. However, there are many factors that adversely affect the clarity of the signal generated by a wrist-worn accelerometer when a user is walking. In particular, if arm swing movements are not well-aligned in time with footfalls, the signal can become very ambiguous as there are multiple sources of acceleration peaks that fall in and out of alignment or may even cancel each other out. This situation can be quite common with certain individuals, especially if walking at a brisk pace where there is more energy in footfalls (heel strikes and ball strikes) and arm swings. Walking on varied surfaces or with certain kinds of footwear can also complicate the signal interpretation.

Figure 5:
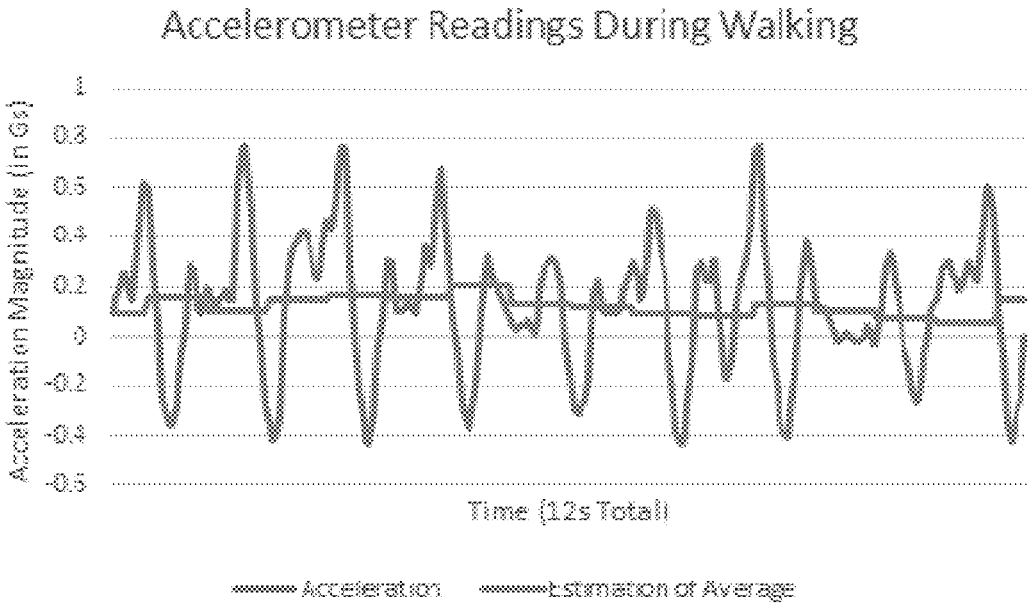
FIG. 5 shows a typical example of a case where the accelerometer data is difficult to interpret due to conflicting signals.

FIG. 5 shows a typical example of a case where the accelerometer data is difficult to interpret due to conflicting signals during walking. As shown in FIG. 5, acceleration magnitude is calculated by taking the square root of the sum of squares of each accelerometer axis in 12 seconds. Several sub-peaks can occur in rapid succession (even after low-pass filtering), whereas other peaks are nearly eliminated due to destructive interference. It is not clear which threshold crossing is eliminated as steps, which is kept, and which leads to inaccurate pedometer readings.

With the advance of wearable computing platforms including additional sensors, there is a potential to address this issue by capturing more sensor data. For example, although acceleration data can be ambiguous to read in many circumstances, clearer results can be obtained by employing additional onboard sensors, such as a gyroscope or a magnetic compass.

Figure 6:
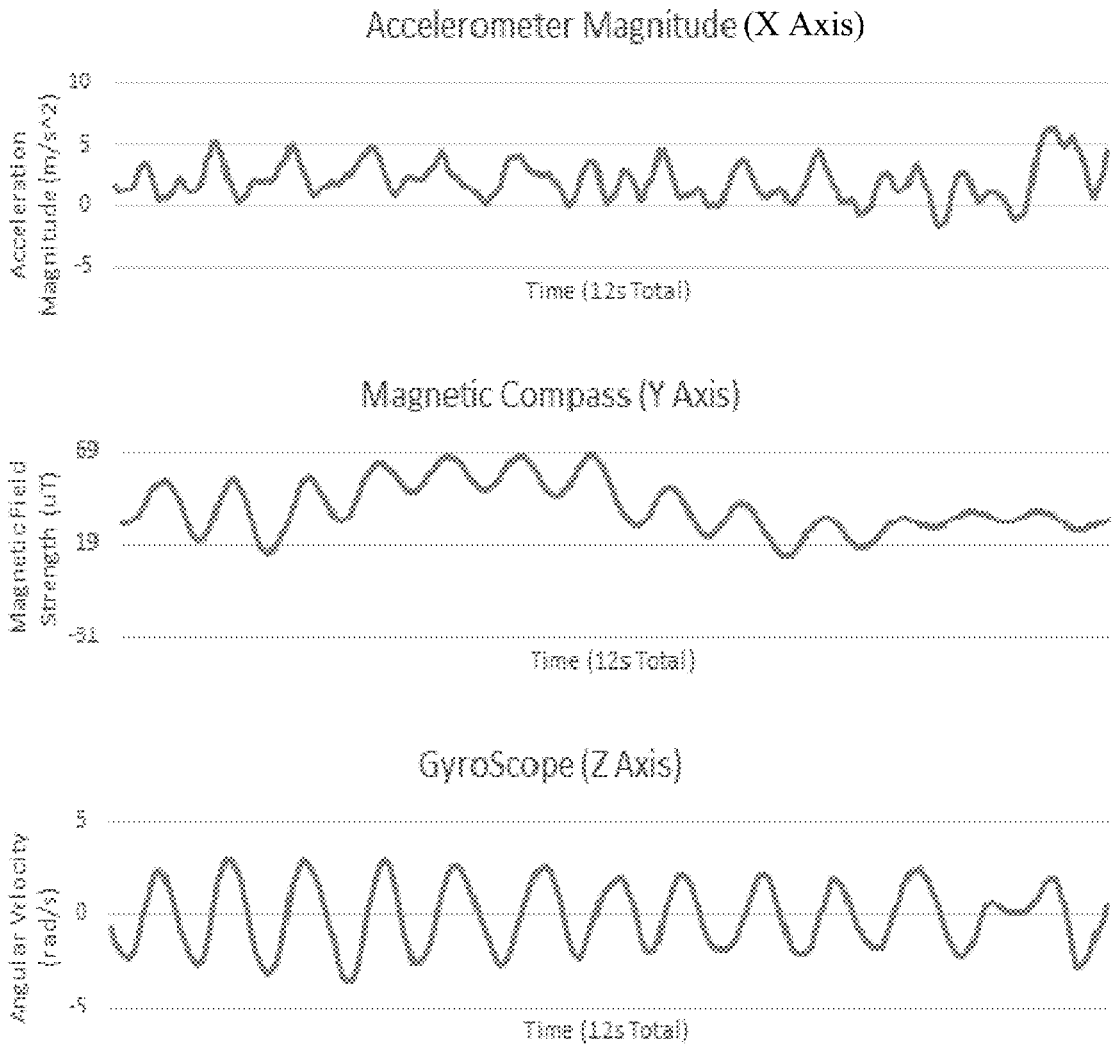
FIG. 6 compares data captured during a brisk walking session using three different onboard sensors.

FIG. 6 compares data captured during a brisk walking session using three different onboard sensors. As shown in FIG. 6, magnetic compass signals are represented by magnetic field strength on the Y axis and are measured in uT. Gyroscope signals are represented by angular velocity on the Z axis and are measured in rad/s. The gyroscope signals on the Z axis and magnetic compass signals on the Y axis (for the most part) are clear to interpret because they are not affected by linear acceleration of footfalls. The magnetic compass signals on the Y axis are vulnerable to electromagnetic interference and frequently change in a walking direction, but nonetheless it is capable of giving clearer readings in many situations. But the values of acceleration magnitude on the X axis are not clear to read because some sub-peaks occur in rapid succession.

While additional sensors are useful for disambiguating human motion data, it is not practical to have them active and powered on at all times. For example, some magnetic compass sensors consume electrical power at a rate of close to 20 times that of an accelerometer, and some gyroscopes consume over 100 times as much. Many wrist-mounted wearable computing devices are typically designed to last 24 hours or more on a single battery charge, and leaving additional sensors continuously active can greatly reduce battery life.

Therefore, a challenge for the wearable sensor devices is not only to maximize the physical activity recognition accuracy, but also to simultaneously minimize the electrical power consumption of the onboard sensors.

To model the amount of power consumed by a set including N number of sensors $\{s_1, s_2, \ldots s_N\}$, a reasonably accurate estimation can be made by multiplying the amount of time $t_i$ that each sensor $s_i$ spends in an active state by a static coefficient approximating the power consumption rate $\mu_i$ of $s_i$ (such values are typically measured in micro Amperes), and summing up results of N number of sensors. That is, for the set including N number of sensors, the power consumption of the set P(S) can be defined by:

$$P(S)=\Sigma_{i=1}^{N} t_i \mu_i \quad (1)$$

Although most sensors still consume a small amount of power when they are in the inactive state, the amount of power consumed is typically small and continuous over time. Thus, a part of base power consumption of the wearable system is simply considered and is not included in the model. Similarly, extra power consumption of the CPU that results from processing additional active sensors is complex. However, the extra power consumption of the CPU is estimated to be small enough relative to the sensor power usage so as to not warrant inclusion either.

In an activity recognition model, it may be assumed that a function F is used by inputting a set of sensor readings $S_A$ over a time period T which is some non-empty subset of the set containing a plurality of sensors (i.e., $S_A \subseteq S$) and outputting the number of instances of a physical action (also called action) of interest (e.g., footsteps).

The behavior of F is that adding additional sensors as an input can only increase the activity recognition accuracy of F, or at worst have no change. Assuming that the function F can always ignore the input from unhelpful sensor readings, so additional provided information never lowers recognition accuracy.

Formally, it means that for any subset $S_A$ of the plurality of sensors S, any superset of $S_A$ has better recognition accuracy or at worst the same. It is assumed that the activity counting function F may obtain the highest accuracy if it uses an entire set of the plurality of sensors S, but it can also obtain the same recognition accuracy (or less accuracy) by using only a subset of the plurality of sensors S.

Therefore, for the time period T, a total number of instances of an action being performed a can always be counted by using:

$$F(S, T)=\alpha,\ \alpha \in \mathbb{N}_0 \tag{2}$$

Similarly, for a subset $S_A$ of S, an accuracy level of $a_A$ can be obtained by:

$$F(S_A, T)=\alpha_A,\ \alpha_A \in \mathbb{N}_0 \tag{3}$$

An error $\epsilon_A$ represents the amount of error that results from using a specific subset of the plurality of sensors available compared to maximum accuracy that can be achieved by using the plurality of sensors. The error $\epsilon_A$ of a subset of sensors $S_A$ can be defined by the absolute difference between a and $a_A$. That is, the error $\epsilon_A$ is obtained by:

$$\epsilon_A=|a-a_A| \tag{4}$$

where a is the most accurate count of a total number of instances of a physical action being performed in a sensor set including N number of sensors; and $a_A$ is a total number of instances of the physical action in the sensor subset $S_A$.

Figure 7:
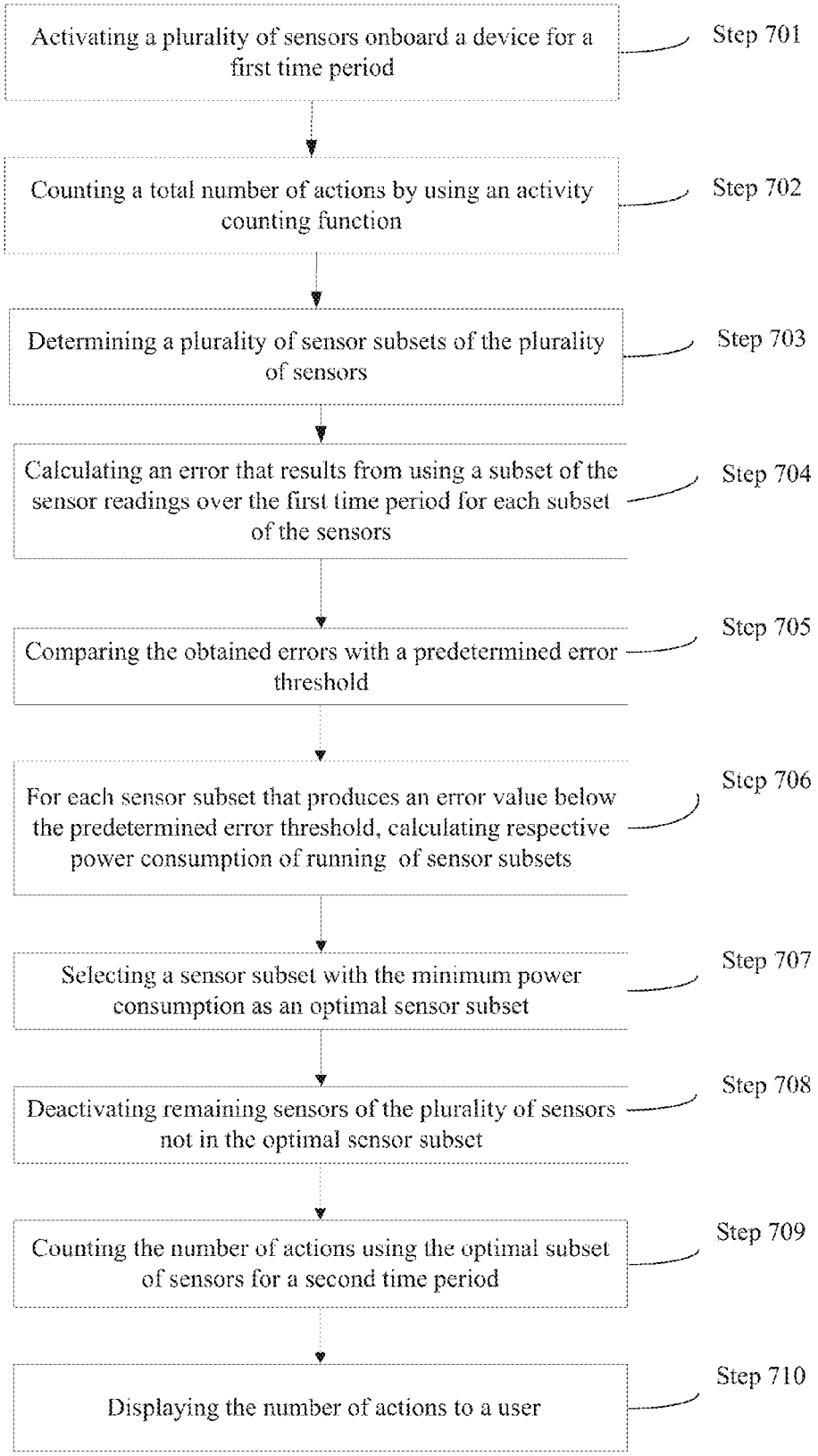
FIG. 7 shows a decision-making process for deciding which sensors to activate or deactivate over time consistent with the disclosed embodiments.

FIG. 7 shows a decision-making process for deciding which sensors to activate or deactivate over time. As shown in FIG. 7, the process includes the following steps.

It is assumed that a wearable system has three sensors including an accelerometer $s_1$, a gyroscope $s_2$, and a magnetic compass $s_3$. A target physical action to be detected is footsteps. At the beginning, a plurality of sensors S onboard a device are activated for a first time period $T_e$ (Step 701). The first time period $T_e$ is a short fixed time period (e.g., 15 seconds).

The plurality of sensors may refer to all of desired number of sensors onboard the wearable system for measuring or recognizing a total number of instances of a physical action being performed. The plurality of sensors may be determined by a user or may be determined by the system based on relevance among the sensors with respect to the physical action to be detected or measured, such as step, heartbeat, or other biometric readings. In certain embodiments, the plurality of sensors may include all sensors onboard the wearable system.

Then, based on sensor data sent from the activated sensors, a total number of physical actions is counted by using an activity counting function (Step 702). For example, a footstep counting function which may use a combination of peak detection or threshold crossing is used to count a total number of footsteps. This step may be correlated across multiple sensors. The activity counting function $F(S, T_e)$ is used to count a total number of actions (e.g. footsteps) taken for the first time period $T_e$. Therefore, a total number of instances of an action being performed a in the sensor set including N number of sensors can be counted by using:

$$F(S, T_e)=\alpha,\ \alpha \in \mathbb{N}_0 \tag{5}$$

Further, a plurality of sensor subsets of the plurality of sensors is determined (Step 703). The following steps are performed for each subset of sensors of the set of N sensors.

Assuming a subset of M sensors is selected from the set of N sensors, for the number M of sensors in each subset, there are [N*(N−1)* . . . *(N−M+1)/M*(M−1) . . . *1] possible subsets of M sensors. For example, for N=5 and M=3, there are 10 possible subsets.

For example, for a wearable system having three sensors (one accelerometer $s_1$, one gyroscope $s_2$, and one magnetic compass $s_3$), i.e., N=3, for M=1, there are 3 possible subsets: $\{s_1\}$, $\{s_2\}$, and $\{s_3\}$; for M=2, there are 3 possible subsets: $\{S_1, s_2\}$, $\{s_1, s_3\}$, and $\{s_2, s_3\}$; and for M=3, there are 1 possible subset: $\{s_1, s_2, s_3\}$. Therefore, there are 7 (i.e., 3+3+1=7) possible sensor subsets of the set of 3 sensors. Other methods may also be used to determine subset of the sensors, different number of sensors may be included in each subset.

It should be noted that in practice, one sensor (e.g., accelerometer $s_1$) may be continuously kept on in an active state in most cases, because the sensor has very low power consumption and is typically in continuous use for other applications onboard the wearable system. Thus, when accelerometer $s_1$ is continuously kept on in the active state, the wearable system with 3 sensors has only 4 possible sensor configurations. That is, the 4 possible sensor configurations are $\{s_1, s_2, s_3\}$, $\{s_1, s_2\}$, $\{s_1, s_3\}$, and $\{s_1\}$, respectively.

Other indexes (e.g., heartbeat) may also be calculated from the sensor data in each subset by using a corresponding calculation function based on a user's preference.

Because the plurality of sensors are active for the first time period $T_e$, for each subset $S_A$ of the sensor set S, an error $\epsilon_A$ that results from using a subset of the sensor readings over the first time period $T_e$ is calculated (Step 704). The error $\epsilon_A$ represents the amount of error that results from using a specific subset of the plurality of sensors available compared to maximum accuracy that can be achieved by using the plurality of sensors.

Specifically, the error $\epsilon_A$ of the sensor subset $S_A$ can be defined by the absolute difference between $\alpha$ and $\alpha_A$. $\alpha$ is a total number of instances of an action being performed based on the sensor set S, and $\alpha_A$ is a total number of instances of the action being performed based on the possible subset $S_A$ of the sensor set S. For a sensor subset $S_A$ of S, $\alpha_A$ can be obtained by:

$$F(S_A, T_e)=\alpha_A,\ \alpha_A \in \mathbb{N}_0 \tag{6}$$

The obtained errors are compared to a certain user-defined error threshold (Step 705). For each sensor subset $S_A$ that produces an error value $\epsilon_A$ below a certain user-defined error threshold $\epsilon_t$ (e.g., 90% error), based on Equation (1), power consumption of running the subsets of the plurality of sensors (using the previously defined power consumption model) is calculated (Step 706).

Further, a sensor subset with the minimum power consumption is selected as an optimal sensor subset $S_O$ (Step 707). That is, the optimal sensor subset $S_O$ is defined by:

$$S_O=\arg\min_{S_A}(P(S_A),\ s.t.\ |F(S, T_e)-F(S_A, T_e)|<\epsilon_t) \tag{7}$$

where $\epsilon_t$ is a user-defined error threshold; $P(S_A)$ is a power consumption for the sensor subset $S_A$; $F(S, T_e)$ is a total number of instances of a physical action being performed in a sensor set S including N number of sensors for the first time period $T_e$; and $F(S_A, T_e)$ is a total number of instances of a physical action $a_A$ in the sensor subset $S_A$ for the first time period $T_e$.

Further, remaining sensors in the plurality of sensors not in the optimal sensor subset $S_O$ are deactivated (Step 708). The number of physical actions (i.e., footsteps) taken using the optimal subset of sensors for a second time period $T_b$ is counted (Step 709). The second time period $T_b$ (e.g., 100 seconds) is substantially longer than the first time period $T_e$ (e.g., 15 seconds). That is, $T_b >> T_e$. The time periods $T_e$ and $T_b$ may be appropriately tuned in order to provide a balance of minimizing the power consumption and maintaining the error below the user-defined error threshold. The first time periods $T_e$ may be tuned based on Equation (7). That is, the error may be recalculated by changing the first time periods $T_e$. When the updated error is less than the user-defined error threshold, a sensor subset with the minimum power consumption is selected again. The user or the system may also change the second time period $T_b$ to obtain desired calculation results of the optimal sensor subset.

In one embodiment, if a target error value is less than 90% error, and the system determines that such accuracy can be obtained during a current physical activity (e.g., brisk walking) by using either the accelerometer and the gyroscope or the accelerometer and the magnetic compass, the system estimates the power consumption of each alternative. Because a gyroscope often consumes up to 5 times the power of a magnetic compass consumes, the system may select the accelerometer and the magnetic compass configuration. Therefore, only these two sensors are used for the next time period (for example, 100 seconds) before repeating the entire process again to determine whether a different sensor configuration is optimal for tracking the current activity.

After the second time period $T_b$ is expired, the plurality of sensors are activated again, and the process goes back to Step 701.

As a special exceptional case, if it happens that $S_O$=S (i.e., all the sensors must be kept active in order to remain above the error threshold $\epsilon_t$), then Step 708 and Step 709 are skipped and the process goes back to Step 701 immediately for the next time period $T_e$. That is, when $S_O=\{s_1, s_2, s_3\}$ for the wearable system with 3 sensors, Step 708 and Step 709 are skipped and the process goes back to Step 701 immediately for the next time period $T_e$.

If a user transits to a different physical activity such as running, the system can quickly determines during the next check that the accelerometer alone is able to achieve sufficient accuracy, and all other sensors are disabled for the next 100 second interval.

Finally, after the number of actions using the optimal subset of sensors for a second time period $T_b$ is counted, the number of actions (e.g., footsteps) may be displayed to the user by the display screen of the system (Step 710).

Although it may appear that computing the optimal sensor configuration may have a prohibitively large time complexity because there are $2^N-1$ sensor configurations (i.e., non-empty subsets) to investigate for N number of sensors, there are two mitigating factors that help to alleviate this issue: (1) in most cases, the number of sensors used is a small integer (e.g., less than 5); (2) it is often that one sensor (e.g., an accelerometer) is continuously kept on in an active state, because it has very low power consumption and is typically in continuous use for other applications onboard the wearable device.

It is understood that the disclosed power consumption model is not limited to the wearable system usage scenario. The disclosed systems and methods can also be applied to any mobile devices, such as smart phones, tablets, smart watches, and so on. The disclosed methods can also be applied as the core function for other systems, such as a health monitoring system.

Further, although the method for balancing recognition accuracy and power consumption is disclosed for illustrative purposes, similar concept and approach can be applied to other wearable systems, for example, image recognition, etc. Other applications, advantages, alternations, modifications, or equivalents to the disclosed embodiments are obvious to those skilled in the art.

What is claimed is:

1. A method for balancing recognition accuracy and power consumption, comprising:

activating a plurality of sensors onboard a device for a first time period;

based on sensor data sent from the activated sensors, calculating sensor readings by using a calculation function;

determining a plurality of sensor subsets of the plurality of sensors;

calculating corresponding errors for the plurality of sensor subsets for the first time period;

comparing the obtained errors to a user-defined error threshold;

from the plurality of sensor subsets that produce the error below the user-defined error threshold, calculating respective power consumption of running the sensor subsets of the plurality of sensors;

selecting a sensor subset with minimum power consumption from the sensor subsets as an optimal sensor subset;

deactivating the plurality of sensors not in the optimal sensor subset; and calculating sensor readings with the optimal sensor subset for a second time period longer than the first time period.

2. The method according to claim 1, further including:

displaying calculation results to a user.

3. The method according to claim 1, wherein:

provided that a sensor set includes N number of sensors $\{s_1, s_2, \ldots S_N\}$, a power consumption function of the sensor set is defined by:

$$P(S)=\Sigma_{i=1}^{N} t_i \mu_i$$

wherein $t_i$ is time that sensor $s_i$ spends in an active state; and $\mu_i$ is a static coefficient approximating the power consumption rate of $s_i$.

4. The method according to claim 1, wherein:

provided that the first time period is $T_e$, the sensor reading of an action being performed a is calculated by:

$$F(S, T_e)=a$$

wherein $S=\{s_1, s_2, \ldots s_N\}$ is the sensor set including N number of sensors; and F( ) is the calculation function for calculating the sensor reading.

5. The method according to claim 4, wherein:

the error of the sensor subset $S_A$ is calculated by an absolute difference between $F(S, T_e)$ and $F(S_A, T_e)$, wherein F( ) is the calculation function for calculating the sensor readings; S is the sensor set including N number of sensors; $T_e$ is the first time period; and F(S, $T_e$) and $F(S_A, T_e)$ are the sensor readings of an action being performed in the sensor set S and the sensor subset $S_A$, respectively.

6. The method according to claim 5, wherein:

the optimal sensor subset $S_O$ of the sensor set S is defined by:

$$S_O = \underset{S_A}{\operatorname{argmin}}(P(S_A),$$
$$\text{s.t. } |F(S, T_e) - F(S_A, T_e)| < \varepsilon_t)$$

wherein $\epsilon_t$ is a constant value representing a user-defined error threshold; $F(S, T_e)$ is the sensor readings of the action being performed in the sensor set S including N number of sensors for the first time period $T_e$; $F(S_A, T_e)$ is the sensor readings of the action in the sensor subset $S_A$ of the sensor set S for the first time period $T_e$; and $P(S_A)$ is the power consumption function for the sensor subset $S_A$ of the sensor set S.

7. The method according to claim 1, further including:

activating the plurality of sensors onboard the device again after the second time period is expired.

8. The method according to claim 1, further including:

tuning the first time period and the second time period for balancing the recognition accuracy and the power consumption.

9. A wearable system for balancing recognition accuracy and power consumption, comprising:

a sensor data calculation module configured to calculate sensor readings of a plurality of sensors by using a calculation function when the plurality of sensors onboard a device are activated for a first time period;

a determination module configured to determine a plurality of sensor subsets of the plurality of sensors;

an error calculation module configured to calculate corresponding errors for the plurality of sensor subsets for the first time period and compare the obtained errors to a user-defined error threshold;

a power consumption calculation module configured to, from the plurality of sensor subsets that produce the error below the user-defined error threshold, calculate respective power consumption of running the sensor subsets of the plurality of sensors; and a selection module configured to select a sensor subset with minimum power consumption from the sensor subsets as an optimal sensor subset and deactivate a plurality of sensors not in the optimal sensor subset.

10. The system according to claim 9, wherein the sensor data calculation module is further configured to:

calculate sensor readings with the optimal sensor subset for a second time period longer than the first time period.

11. The system according to claim 9, wherein:

provided that a sensor set includes N number of sensors $\{s_1, s_2, \ldots s_N\}$, a power consumption function of the sensor set is defined by:

$$P(S)=\Sigma_{i=1}^{N} t_i \mu_i$$

wherein $t_i$ is time that sensor $s_i$ spends in an active state; and $\mu_i$ is a static coefficient approximating the power consumption rate of $s_i$.

12. The system according to claim 9, wherein:

provided that the first time period is $T_e$, the sensor reading of an action being performed a is calculated by:

$$F(S, T_e)=a$$

wherein $S=\{s_1, s_2, \ldots s_N\}$ is the sensor set including N number of sensors; and F( ) is the calculation function for calculating the sensor reading.

13. The system according to claim 12, wherein:

the error of the sensor subset $S_A$ is calculated by an absolute difference between $F(S, T_e)$ and $F(S_A, T_e)$, wherein F( ) is the calculation function for calculating the sensor readings; S is the sensor set including N number of sensors; $T_e$ is the first time period; and $F(S, T_e)$ and $F(S_A, T_e)$ are the sensor readings of an action being performed in the sensor set S and the sensor subset $S_A$, respectively.

14. The system according to claim 13, wherein:

the optimal sensor subset $S_O$ of the sensor set S is defined by:

$$S_O = \underset{S_A}{\operatorname{argmin}}(P(S_A),$$
$$\text{s.t. } |F(S, T_e) - F(S_A, T_e)| < \varepsilon_t)$$

wherein $\epsilon_t$ is a constant value representing a user-defined error threshold; $F(S, T_e)$ is the sensor readings of the action being performed in the sensor set S including N number of sensors for the first time period $T_e$; $F(S_A, T_e)$ is the sensor readings of the action in the sensor subset $S_A$ of the sensor set S for the first time period $T_e$; and $P(S_A)$ is the power consumption function for the sensor subset $S_A$ of the sensor set S.

15. The system according to claim 9, wherein:

the plurality of sensors onboard the device are activated again after the second time period is expired.

16. The system according to claim 10, wherein:

the first time period and the second time period are tuned for balancing the recognition accuracy and the power consumption.

* * * * *